United States Patent [19]

Nishino et al.

[11] Patent Number: 4,678,256

[45] Date of Patent: Jul. 7, 1987

[54] CONNECTOR

[75] Inventors: Yoshimitsu Nishino; Wataru Tsuruda; Kihachiro Koike; Kensaku Matsuoka, all of Tokyo, Japan

[73] Assignees: Japan Aviation Electronics Industry Limited; NEC Corporation; Hirose Denki Kabushiki Kaisha, all of Tokyo, Japan

[21] Appl. No.: 804,424

[22] Filed: Dec. 4, 1985

[30] Foreign Application Priority Data

Dec. 10, 1984 [JP] Japan ..... 59-186923[U]
Dec. 10, 1984 [JP] Japan ..... 59-186924[U]

[51] Int. Cl.[4] ..... H01R 13/629
[52] U.S. Cl. ..... 439/347; 439/607
[58] Field of Search ..... 339/91 R, 143 R, 14 R

[56] References Cited

U.S. PATENT DOCUMENTS

| | | | |
|---|---|---|---|
| 3,566,336 | 2/1971 | Johnson et al. | 339/91 R |
| 4,002,389 | 1/1977 | Mammel | 339/91 R |
| 4,113,179 | 9/1978 | McKee | 339/91 R |
| 4,460,230 | 7/1984 | McKee et al. | 339/91 R |
| 4,512,618 | 4/1985 | Kumar | 339/143 R |
| 4,518,209 | 5/1985 | Negley | 339/143 R |
| 4,521,062 | 6/1985 | Kurbikoff et al. | 339/143 R |
| 4,556,270 | 12/1985 | Schutzle et al. | 339/91 R |

FOREIGN PATENT DOCUMENTS

| | | | |
|---|---|---|---|
| 2613907 | 10/1977 | Fed. Rep. of Germany | 339/143 R |
| 2708998 | 9/1978 | Fed. Rep. of Germany | 339/91 R |

*Primary Examiner*—John McQuade
*Attorney, Agent, or Firm*—Pollock, Vande Sande and Priddy

[57] ABSTRACT

In a connector in which a plug connector is held in a cover, locking members are mounted on the cover, and when the plug connector is engaged with a receptacle connector the locking members automatically engage locking pieces of the receptacle connector to lock the connectors in an engaged state, the plug connector is entirely housed in the cover for release levers of the locking members used for unlocking. The locking pieces of the receptacle connector are formed integrally with the body of the connector and each is fitted into a square reinforcing frame formed integrally with the flange of a metallic shell of the receptacle connector, by which the locking pieces are mechanically reinforced.

13 Claims, 19 Drawing Figures

CONNECTOR

BACKGROUND OF THE INVENTION

The present invention relates to a connector which is comprised of a plug connector and a receptacle connector, each having a plurality of contacts, and which is designed so that the corresponding contacts can be engaged with or disengaged from each other through a single manual snap in or out operation.

A conventional plug connector has such a structure as shown in FIGS. 1 and 2. The plug connector, indicated generally by 11, has a plurality of contacts incorporated in a body 12 of an insulating material. The contacts project at one end from the front end face of the body 12 to form plug contact pins 13 and are led out at the other end from the rear end face of the body 12 to form terminals 14. A shell 15 made of metal is mounted on the front end face of the body 12 in a manner to surround an array of all the plug contact pins 13. The shell 15 has formed integrally therewith a flange 15*a* which protrudes from the peripheral surface of the body 12.

Conventionally the plug connector 11 is received or housed in a cover 16 with the flange 15*a* secured by means of screws 20 to the front wall of the cover 16. Resilient metallic locking members 18 are respectively held in recesses 17 made in forward portions of both side walls of the cover 16. Locking portions 21 of the locking members 18 project forwardly of the cover 16 through slots 19 made in its front wall to communicate with the recesses 17, the projecting end portions of the locking portions 21 being bent inwardly. A fixing projection 22 of each locking member 18 is fixedly inserted in a groove of the cover 16 at the base of the locking portion 21 in each recess 17. The locking member 18 is rearwardly extended out of the cover 16 obliquely thereto and then turned back to form a release lever 23, the inner end of which is resiliently urged against the side wall of the cover 16 in the recess 17.

On the other hand, a conventional receptacle connector 30 has such a structure as depicted in FIG. 3. A body 31 of an insulating material has on its front face a protrusion 32 formed integrally therewith for insertion into the shell 15 of the plug connector 11. The front end face of the protrusion 32 has made therein contact receiving holes 33 in a predetermined pattern of array, in which are embedded receptacle contacts (not shown) for resilient engagement with the plug contact pins 13. The protrusion 32 is fitted into a metallic shell 34, which has its flange 34*a* secured to the front face of the body 31. Terminals of the receptacle contacts in the body 31 are led out therefrom, though not shown.

On both sides of the protrusion 32 locking pieces 35, which project forwardly of the flange 34*a*, are fixed by screws 36 to the body 31. Projecting end portions of the locking pieces 35 are bent outwardly from each other.

When the plug connector 11 and the receptacle connector 30 are assembled together, the shell 34 of the latter is fitted into the shell 15 of the former, as shown in FIG. 2. In this instance the locking portions 21 are resiliently displaced outward by the locking pieces 35 and then their bent end portions are locked together, retaining the plug connector 11 and the receptacle connector 30 in their connected state. In this way, the connectors 11 and 30 can easily be connected together simply by urging them against each other, that is, by a single snap-in operation. In order to disconnect them, it is necessary only to urge the release levers 23 toward the recesses 17 as indicated by the arrows 38, by which the locking portions 21 are turned outwardly in opposite directions with the fulcrums at the positions of the fixing projections 22, as indicated by the arrows 39, and are unlocked from the locking pieces 35.

With the conventional plug connector 11 described above, since the shell 15 protrudes forwardly of the front wall of the cover 16, there is the possibility that when the shell 15 is subjected to an external force, for example, when the plug connector 11 happens to be dropped on the floor together with the cover 16, the shell 15 may be deformed and the plug connector 11 cannot be fitted with the receptacle connector 30. Similarly, the locking portions 21 protrude forwardly of the cover 16 and hence are readily deformed or broken by an external force. When the locking portions 21 are deformed, its function of locking the plug connector 11 with the receptacle connector 30 will be lost.

Furthermore, if the release levers 23 of the locking members 18 are pressed too strong when unlocking the connectors 11 and 30, the locking members 18 are deformed or their resiliency is degraded and their normal locking and unlocking functions are lost.

On the other hand, according to the conventional receptacle connector 30, it is necessary to prepare the locking pieces 35 separately of the body 31 and secure the former to the latter by means of screws. This increases the number of parts used and calls for the screw clamping operation. Moreover, there is a possibility that the locking pieces 35 are mounted on the body 31 at a displaced angle $\theta$ relative to its correct direction, as shown in FIG. 4, making the receptacle connector 30 defective. Even if the locking pieces 35 are not tilted, there are sometimes variations in the spacing between the locking pieces 35 caused during tightening of screws 36, making it impossible to correctly fit the receptacle connector 30 with the plug connector 11.

It is therefore an object of the present invention to provide a plug connector which has a shell and locking portions almost free from the influence of an external force to ensure correct engagement with the mating receptacle connector, and which can be locked into and unlocked from its state of engagement with the receptacle connector through a single manual operation.

Another object of the present invention is to provide a plug connector which can achieve a stable connection and disconnection operation even if the release levers of the locking members are urged too hard for unlocking the connectors from each other.

Another object of the present invention is to provide a plug connector which ensures shielding against electromagnetic waves.

Another object of the present invention is to provide a receptacle connector which is small in the number of parts involved and hence is easy to assemble.

Yet another object of the present invention is to provide a receptacle connector which can correctly be engaged with the plug connector at all times.

SUMMARY OF THE INVENTION

According to the present invention, the plug connector is entirely housed in its metallic cover and the front end of its metallic shell is positioned adjacent the front open end of the cover. Locking members are pivotally received in recesses made in both side walls of the cover. Each locking member is made by bending a strip of resilient metal and has at its intermediate portion a shaft, through which it is made rotatable about an axis parallel to the front and side faces of the cover. That portion of each locking member extending forwardly of the shaft projects out of the recess toward the front opening of the cover through a slot made therein to communicate with the recess. The projecting end portions of both locking members are bent inwardly to form locking portions, which locate inside the cover in opposed relation to the respective side faces of the shell. That portion of each locking member extending rearwardly of the shaft projects out of the recess to form a release lever for unlocking. The rear end portion of the release lever is bent back and the bent end portion is urged against a partition wall formed integrally with the cover. Accordingly, the locking portions are both inwardly biased. Means is provided for limiting inward rotation of each locking resulting from the biasing force of the bent end portion against the partition wall so as to resiliently retain the locking portion at its predetermined position. To this end, the locking member is designed so that its portion extending forwardly of the shaft is urged against the inner wall of the slot leading to the front opening of the cover on the side of the partition wall thereof. Alternatively, the aforementioned biasing force at the bent-back portion is received by the inside surface of the side wall of the cover to define the outermost position of the release lever and therefore the innermost position of the locking member. Since no other portions than the release levers are exposed outside the cover, there is no fear of the shell and the locking portions being deformed by an external force, for example, when the plug connector happens to be dropped on the floor.

Furthermore, the cover has formed integrally therewith a stopper for preventing each release lever from being pressed into the recess in excess of a predetermined depth. Accordingly, even if the release lever is pressed too hard when unlocking the plug connector from the receptacle connector, the locking member will not be deformed. Moreover, the resiliency of the locking member will remain unchanged even after long use.

The cover is comprised of top and bottom bodies, i.e. a top cover body and a bottom cover body. The plug connector is positioned in the cover with marginal edges of a flange of the shell of the plug connector fitted in engaging grooves cut in the cover body and is then fixed to the cover by binding the top cover body to the bottom cover body. The flange of the shell has lugs, which are pressed into the abovesaid engaging grooves, ensuring correct positioning of the plug connector relative to the cover body. When the cover is made of metal, good electrical connection between the cover and the shell can be achieved and the contacts can be sufficiently shielded from the outside electromagnetically.

Locking pieces are molded integrally with the body of the receptacle connector to extend from both side ends of its front. The locking pieces are opposite both side faces of the shell and have at their projecting end portions clicks molded integrally therewith on the opposite side from the shell. A protrusion molded integrally with the body on the front thereof is covered with the shell. Frame-like reinforcing pieces extend forwardly from both side ends of the flange of the shell and the locking pieces are respectively fitted in the frame-like reinforcing pieces and are thereby mechanically reinforced. By mounting the shell on the body, the locking pieces are automatically held at correct positions and in correct directions. An elongated groove is cut in the front end face of each locking piece along the entire length thereof for receiving the front end of each frame-like reinforcing piece so as to ensure the mechanical reinforcement of the locking piece.

DESCRIPTION OF THE PREFERRED EMBODIMENTS

Figure 5:
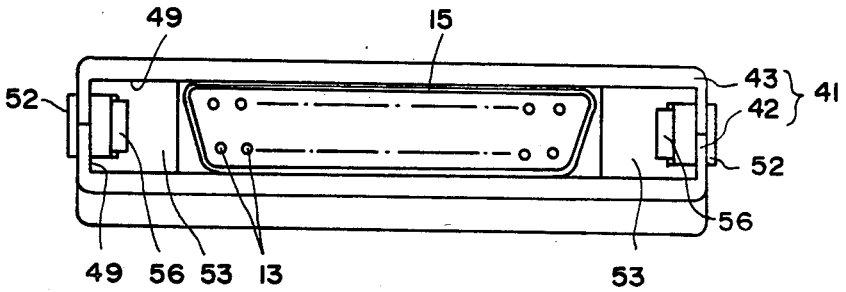
FIG. 5 is a front view illustrating an example of the connector of the present invention.
Figure 6:
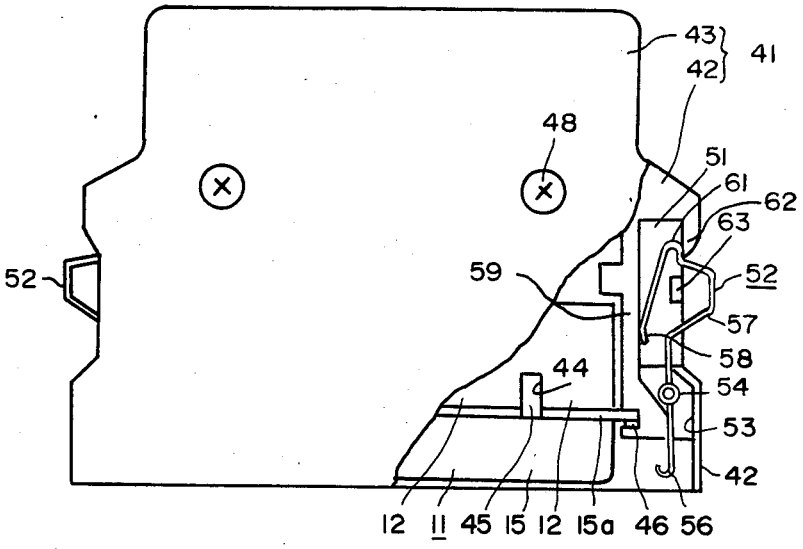
FIG. 6 is a plan view showing the connector of FIG. 5 with its cover partly removed.
Figure 7:
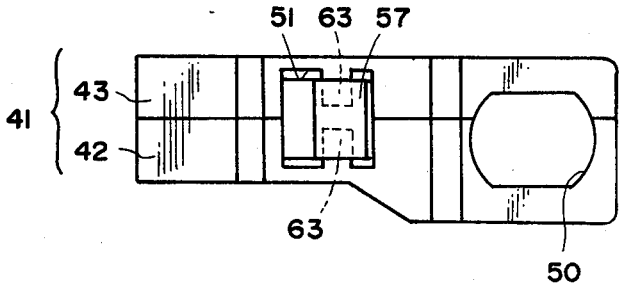
FIG. 7 is a right side view of the connector shown in FIG. 6.
Figure 9:
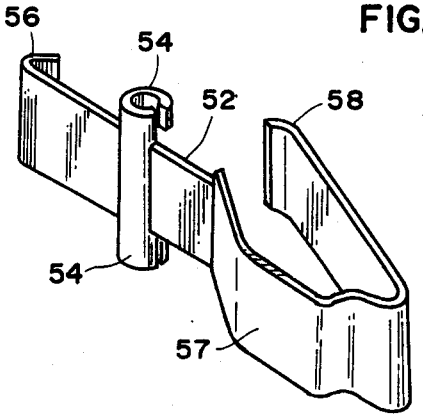
FIG. 9 is a perspective view of a locking member 52.
Figure 8:
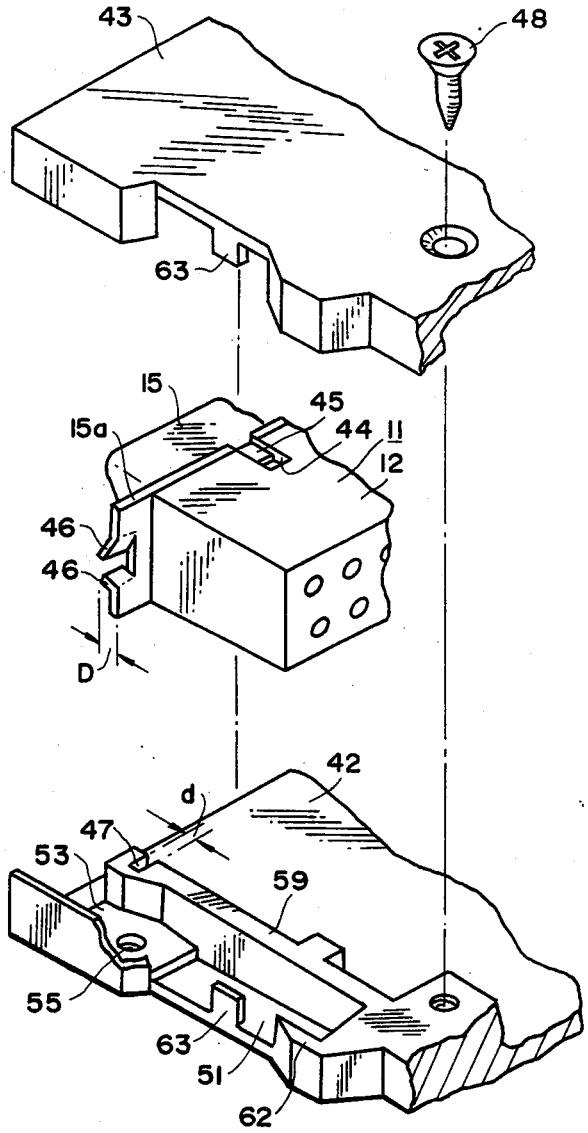
FIG. 8 is an exploded perspective view showing some parts of the cover and a plug connector of the connector depicted in FIG. 5.

FIGS. 6 and 7 illustrate an embodiment of the plug connector according to the present invention. A cover 41 is comprised of top and bottom bodies, i.e. a bottom cover body 42 and a top cover body 43. The cover 41 has fixedly held therein the plug connector 11 between the bottom cover body 42 and the top cover body 43. The plug connector 11 has substantially the same structure as in the past. As depicted in FIGS. 5, 6 and 8, the plug connector 11 has the metallic shell 15 mounted on the front face of the connector body 12 of an insulating material. The plug contact pins 13, which project out of the front face of the connector body 12, are surrounded by the shell 15. Engaging tongues 45 extending from the shell 15 are staked in engaging grooves 44 cut in the connector body 12, by which the shell 15 is fixedly secured to the body 12. The flange 15*a* of the shell 15 has lugs 46 at its both sides.

The bottom cover body 42 and the top cover body 43, which constitute the cover 41, are made of, for example, a metallic material. As shown in FIGS. 6 and 8, engaging grooves 47 are cut in the opposed faces of the bottom cover body 42 and the top cover body 43 at both sides of their forward portions. In FIGS. 6 and 8 the engaging groove 47 of the bottom cover body 42 alone is shown. The width d (FIG. 8) of the engaging groove 47 is selected to be slightly smaller than the height D (FIG. 8) of the lug 46. The side portions of the flange 15*a* of the shell 15 are both inserted into the engaging grooves 47, and in this case, the lugs 46 are pressed into the engaging grooves 47, positioning the plug connector 11 in the cover 41. The bottom cover body 42 and the top cover body 43 are fixedly secured to each other by means of screws 48. The cover 41 has a large square opening 49 in its front and the front face the shell 15 is a little inside the square opening 49. The two side walls of the shell 15 and the cover 41 are spaced apart. In one side of the cover 41 is made a hole 50 through which a cable is led to the connector 11, as shown in FIG. 7.

Both side walls of the cover 41 have made therein recesses 51, in which are received locking members 52. The recesses 51 each communicate with the front opening 49 of the cover 41 through a slot 53. Each locking member 52 is made of resilient sheet metal and has at its intermediate position a shaft 54 formed integrally therewith to extend across the entire width thereof. In each recess 51 a pair of opposed shaft receiving holes 55 (FIG. 8) are made in the bottom cover body 42 and the top cover body 43. The shaft 54 has its opposite end portions rotatably received in the opposed shaft receiving holes 55.

Figure 1:
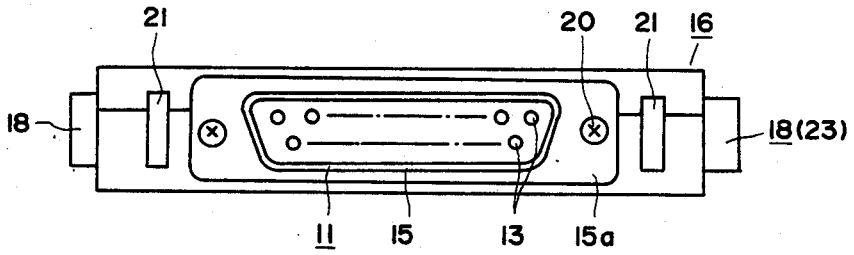
FIG. 1 PRIOR ART
FIG. 1 is a front view showing a conventional connector.
Figure 2:
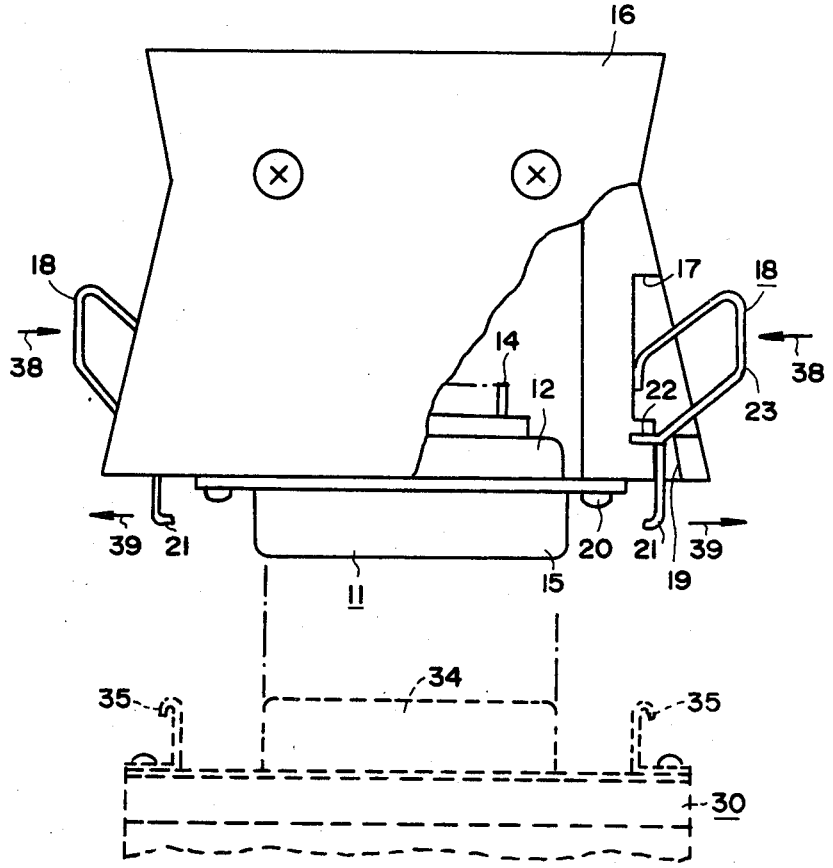
FIG. 2 PRIOR ART
FIG. 2 is a plan view of the connector of FIG. 1 with its cover partly removed.
Figure 3:
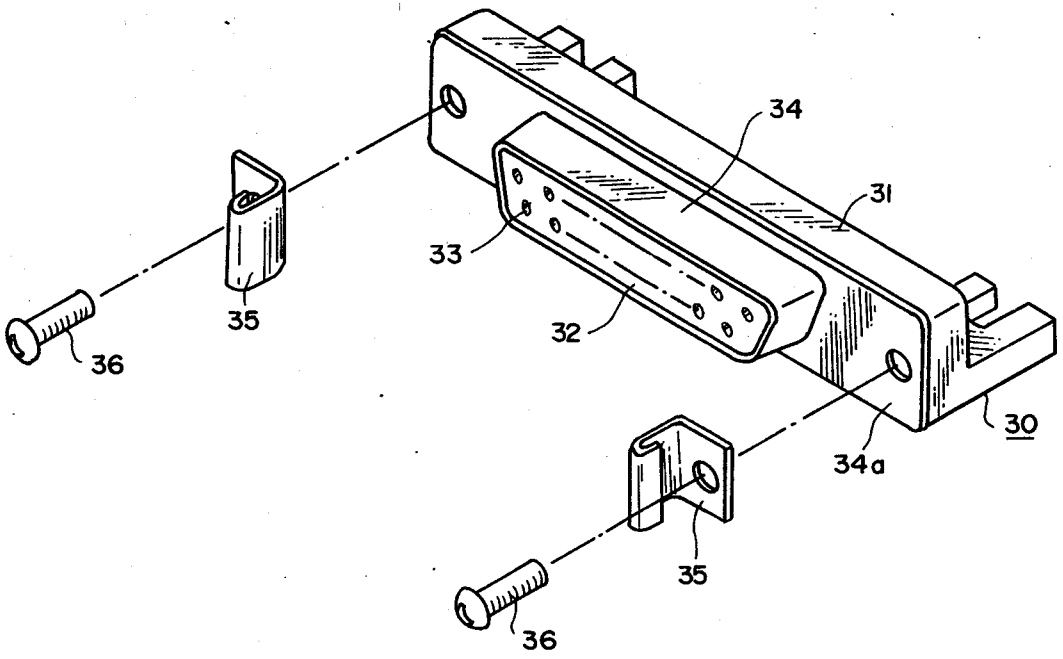
FIG. 3 PRIOR ART
FIG. 3 is an exploded perspective view showing a conventional receptacle connector.
Figure 4:
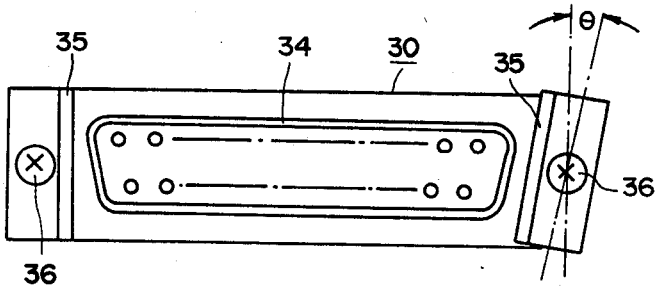
FIG. 4 PRIOR ART
FIG. 4 is a front view showing defective mounting of a locking piece of the conventional receptacle connector.

The portion of each locking member 52 extending forwardly of the shaft 54 projects out of the slot 53 and its projecting end portion is bent toward the shell 15, forming a locking portion 56. The portion of the locking member 52 extending rearwardly of the shaft 54 is bent so that it projects out of the recess 51 to extend along it, forming a release lever 57. The release lever 57 is bent at the rear end of the recess 51 to turn back forwardly and its end portion 58 is held in resilient contact with a partition wall 59 between the recess 51 and the inside of the cover 41. The bent portion 61 is held in resilient contact with an outer side wall 62 of the cover 41 from the inside of the recess 51. The release lever 57 slightly projects out of the recess 51. The bottom cover body 42 and the top cover body 43 have formed integrally therewith a pair of stoppers 63 in opposed relation to the release lever 57. When the bottom cover body 42 and the top cover body 43 are secured by screws to each other with the locking members 52 housed in the recesses 51 and the plug connector 11 positioned as described previously, the locking members 52 and the connector 11 are held inside the cover 41. The plug connector 11 thus held in the cover 41 can be engaged with the receptacle connector in such a manner as described previously in connection with FIG. 2.

Figure 10A:
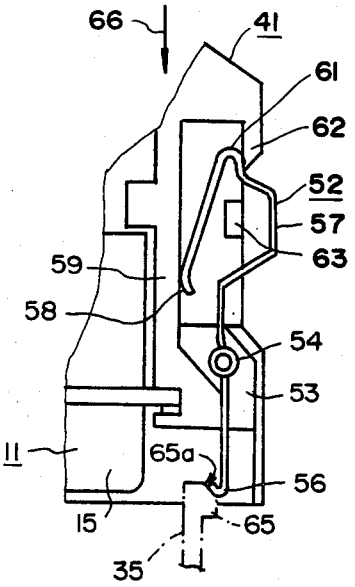
FIGS. 10A to 10C are plan view for explaining the process of engagement between the locking piece and a locking portion 56 when connectors are connected together.
Figure 10B:
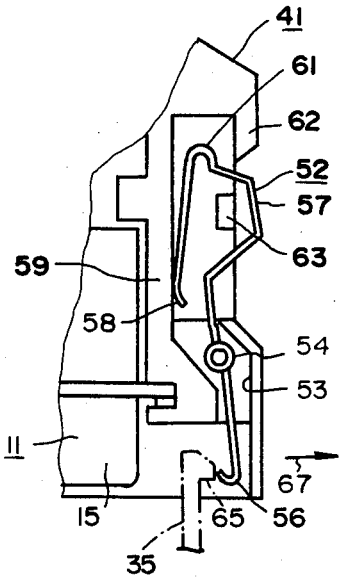
Figure 10C:
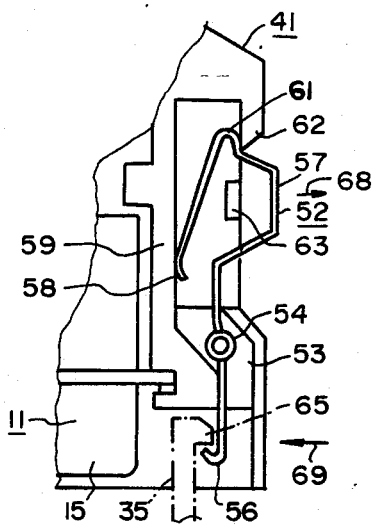

Now, a description will be given, with reference to FIGS. 10A to 10C, of the process for their engagement. FIGS. 10A to 10C illustrate the movement of only one of the locking members 52. When the plug connector 11 is positioned relative to the front of the shell of the receptacle connector (not shown) so that the latter may be received in the shell 15 of the former, the front slope 65*a* of a click 65 of the locking piece of the receptacle connector and the bent slope of the locking portion 56 substantially abut against each other, as shown in FIG. 10A. When the cover 41 is pushed toward the receptacle connector (not shown), as indicated by the arrow 66, so that the shell of the receptacle connector may be inserted into the shell 15, the click 65 of the locking piece 35 urges the locking portion 56 in the direction indicated by the arrow 67 (to the right in FIG. 10B), as shown, to elastically deform the locking member 52, by which the release lever 57 is turned about the shaft 54 counterclockwise in FIG. 10B, bringing the bent portion 61 out of contact with the outer side wall 62 of the cover 41. When the cover 41 is further pushed and the shell of the receptacle connector is fully received in the shell 15 of the plug connector 11 with their contacts held in contact with each other, the click 65 of the locking piece 35 lies more inside the cover 41 than the locking portion 56 and the locking member 52 is elastically restored, engaging the locking portion 56 with the click 65, as depicted in FIG. 10C.

In this state the end portion 58 of the locking member 52 is resiliently urged against the partition wall 59 and the bent portion 61 is in resilient contact with the outer side wall 62 in the direction indicated by the arrow 68, so that the locking portion 56 is resiliently biased clockwise in FIG. 10C with the fulcrum being at the shaft 54. Thus both connectors are stably held in engagement with each other. In this instance, the rear end portion 58 of the locking member 52 is pressed against the partition wall 59, the bent portion 61 is urged against the side panel 62 and the portion of the locking member 52 extending forwardly of the shaft 54 is also pressed against the inner wall of the slot 53 on the side of the partition wall 59. Accordingly, there will be no play in the setting of the locking member 52.

Figure 10D:
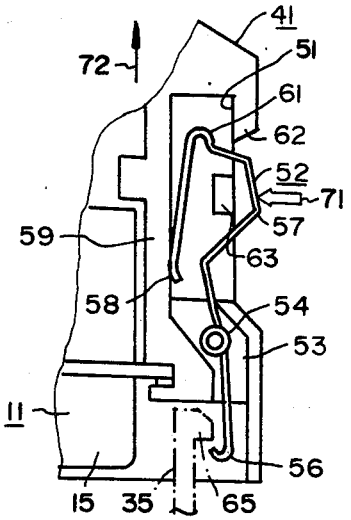
FIG. 10D is a plan view for explaining the operation of disengaging the connectors.
Figure 11:
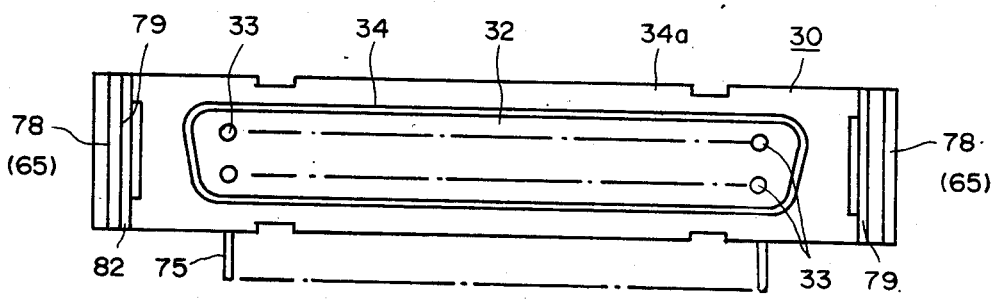
FIG. 11 is a front view illustrating an example of the receptacle connector of the present invention.
Figure 12:
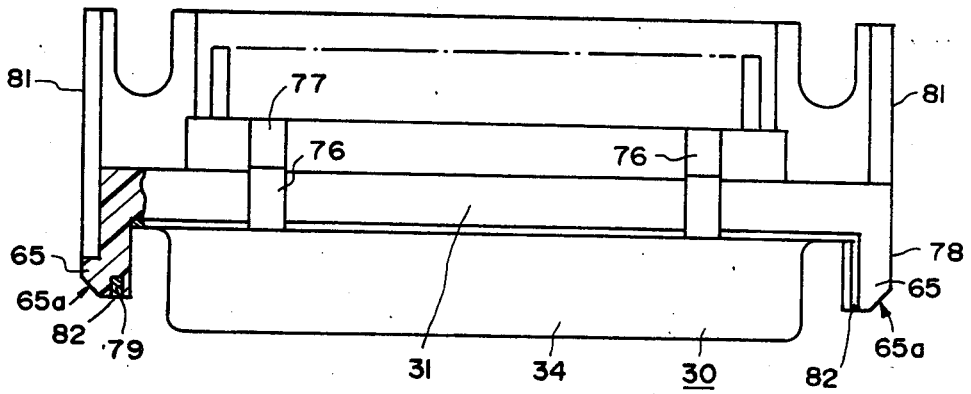
FIG. 12 is a plan view showing the connector of FIG. 11 with its locking piece partly taken off.
Figure 13:
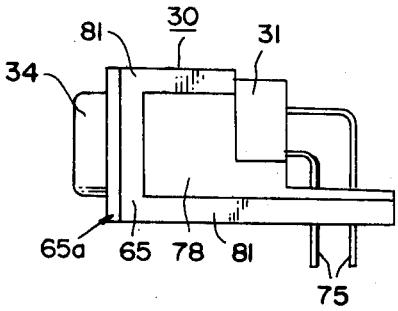
FIG. 13 is a right side view of the connector depicted in FIG. 12.
Figure 14:
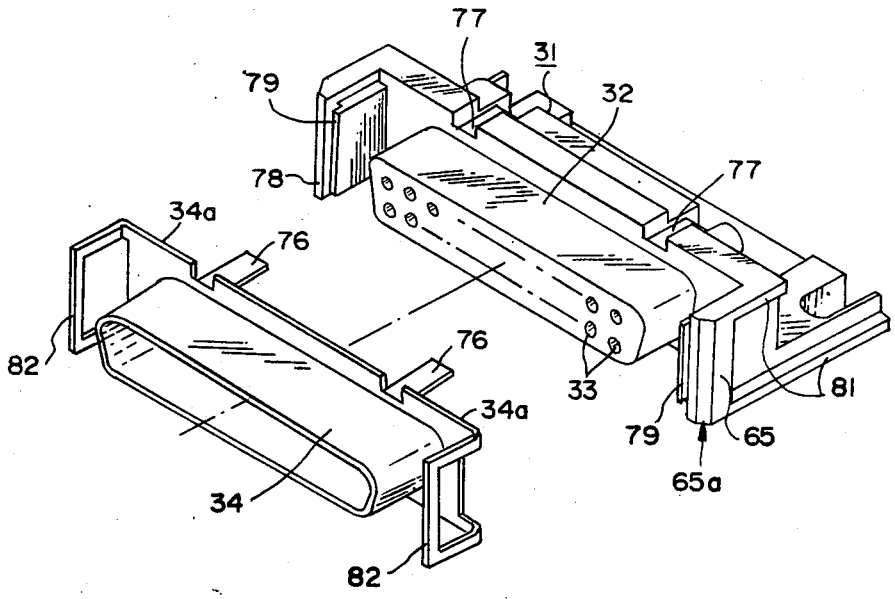
FIG. 14 is an exploded perspective view of the connector shown in FIG. 11.

In order to unlock the plug connector and the receptacle connector from the state of their engagement, it is necessary only to press the release lever 57 toward the recess 51, as indicated by the arrow 71 in FIG. 10D. By this pressing the locking portion 56 is turned about the shaft 54 counterclockwise in FIG. 10D and disengaged from the click 65 of the locking piece 35 of the receptacle connector. By pulling the cover 41 in the direction indicated by the arrow 72 in this state, the plug connector 11 can easily be separated from the receptacle connector (not shown).

As described above, according to the present invention, the plug connector and the receptacle connector can be engaged with and disengaged from each other through a single manual operation as in the past. In addition, the plug connector 11 is entirely enclosed in the cover 41, the locking portions 56 are also located in the cover 41 and only the release levers 57 of the locking members are exposed outside the cover 41, so that the shell 15 and the locking members 56 will not be deformed or broken even if the plug connector 11 receives an external shock, for instance, when it is dropped on the floor.

Even if the release lever 57 is pressed into the recess 51 too hard in the case of unlocking the connectors, the stoppers 63 prevent deformation of the locking member 52 and degradation of its resiliency, ensuring a stable operation for a long time.

In the case where the cover 41 is made of a conductive material as described previously, the lugs 46 formed on the flange 15*a* of the metallic shell 15 are resiliently pressed into engagement with the engaging grooves 47, providing good and stable electrical connection between the cover 41 and the shell 15. Accordingly, the coupling portion of the plug connector and the receptacle connector can be shielded electromagnetically from the outside by the shell 15 and the cover 41, fulfilling the requirements by the FCC Standards in the United States. The locking member 52 may also be rotatably supported by inserting into the tubular end portions projections formed on the cover 41.

Next, a description will be given, with reference to FIGS. 11 to 14, of an embodiment of the receptacle connector 30 according to the present invention. As is the case with the prior art, the connector body 31 of an insulating material has on its front the protrusion 32 molded integrally therewith. The contact receiving holes 33 in the protrusion 32 respectively have received therein receptacle contacts, though not shown, and terminals 75 of the receptacle contacts backwardly project out of the body 31. The peripheral surface of the protrusion 32 is covered with the metallic shell 34. Tongues 76 formed integrally with the shell 34 to extend therefrom rearwardly are staked in grooves 77 cut in the body 31, by which the shell 34 is fixedly secured to the connector body 31.

In the present invention, locking pieces 78 are molded integrally with the body 31 to extend forwardly from both sides of its front and along both sides of the shell 34. The locking pieces 78 have outwardly projecting clicks 65 at their forward end portions. The front end faces of the clicks 65 are tapered outwardly to form slopes 65*a*. In this example an elongated groove 79 for receiving a reinforcing frame is cut in the front end face of each locking piece 78 lengthwise thereof. Furthermore, reinforcing ribs 81 are molded integrally with each locking piece 78 to extend along the upper and lower marginal edges thereof. Square reinforcing frames 82 are extended forwardly from both ends of a flange 34*a* of the shell 34. The front bars of these reinforcing frames 82 are each fitted in the elongated groove 79 of each locking piece 78, while at the same time the locking piece 78 is fitted in the frame 82.

Figure 15A:
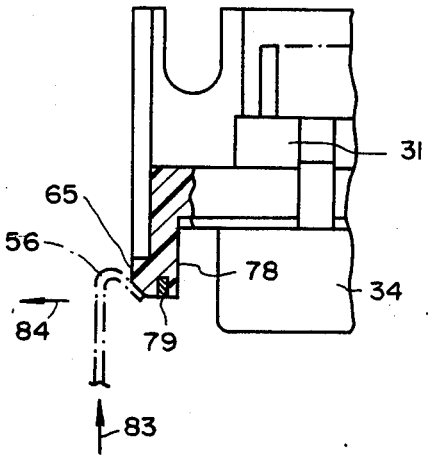
FIGS. 15A and 15B are plan views for explaining the process of engagement of the locking portion of the plug connector with the locking piece of the connector shown in FIG. 11.
Figure 15B:
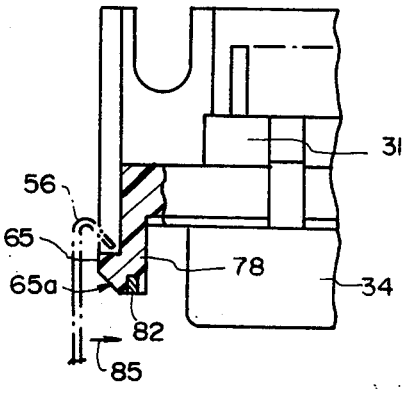

Turning now to FIGS. 15A and 15B, the engagement of the plug connector with the receptacle connector 30 will be described in brief. When the receptacle connector 30 and the plug connector (not shown) are placed face-to-face with each other so that the shell 34 of the former may be inserted into the shell of the latter, the slope of the top end portion of each locking portion 56 of the plug connector abuts against the slope 65*a* of the click 65 of the corresponding locking piece 78, as shown in FIG. 15A. When moving the plug connector (not shown) in the direction of the arrow 83, the locking portion 56 is resiliently displaced by the slope 65*a* of the click 65 in the direction of the arrow 84, after which it moves past the click 65 and then moves in the direction of the arrow 85 owing to its resiliency for engagement with the click 65, as depicted in FIG. 15B. This operation for engagement is the same as that described previously with respect to FIGS. 10A, 10B and 10C, and the disengagement of the connectors is done in the manner described previously in connection with FIG. 10D.

According to the present invention, the connector body 31, the protrusion 32 and the locking pieces 78 of the receptacle connector can be molded as a unitary structure with high accuracy and with ease. On the other hand, the shell 35 and the reinforcing frames 82 can be produced as a unitary structure by means of stamping of sheet metal. By assembling the shell 35 with the body 31, a connector of close dimensional tolerances can easily be obtained. Since the locking pieces 78 are unitary with the body 31, the number of parts used is small, and since they are mechanically reinforced by the reinforcing frames 82, a rigid structure can be obtained. Furthermore, when the receptacle connector is assembled, the spacing and posture of the locking pieces 78 automatically become as predetermined, and they remain unchanged even if the connector is used repeatedly, so that it can always be engaged with the plug connector.

It will be apparent that many modifications and variations may be effected without departing from the scope of the novel concepts of the present invention.

What is claimed is:

1. A connector comprising:

a plug connector having a plurality of plug contact pins projecting out forwardly of a body of an insulating material and a metallic shell mounted on the front of the body in a manner to surround projecting portions of the contact pins arranged in a predetermined pattern;

a cover in which the plug connector is entirely housed with the front end face of its shell positioned near a front opening of the cover, recesses being made in both side walls of the cover and first slots being made in the cover to extend from the recesses to the front opening of the cover; and locking members respectively housed in the recesses of the cover, each locking member being made of a strip of resilient metal and having at its intermediate portion a shaft through which it is pivotally mounted on the cover, a portion of each locking member extending forwardly of the shaft being bent inwardly to form a locking portion which extends forwardly through the first slot in the cover, a gap being defined between the locking member and either side face of the shell of the cover for receiving a locking piece of a receptacle connector, a portion of each locking member extending rearwardly of the shaft having a release lever which projects out of the recess of the cover, the rear end portion of the release lever being bent and the bent end portion being urged against a partition wall made in the cover.

2. A connector according to claim 1 wherein the cover is comprised of a bottom cover body and a top cover body for covering the former and is provided with plug connector positioning means, the plug connector positioned by the positioning means being fixed in the cover by binding the top cover body to the bottom cover body.

3. A connector according to claim 2 wherein engaging grooves are made as the positioning means in the interior of at least one of the bottom cover body and the top cover body at both sides near the front thereof, and a flange extending from either side of the shell is received in each of the engaging grooves.

4. A connector according to claim 3 wherein said flange has lugs which are pressed into the engaging grooves.

5. A connector according to any one of claims 1 to 4 wherein the cover is made of metal.

6. A connector according to claim 1 wherein that portion of each locking member extending forwardly of the shaft is urged against the inner wall of the first slot on the side of the partition wall.

7. A connector according to claim 1 or 6 wherein the bent portion of each locking member is urged against the inside of an outer side wall of the cover from the inside of the recess.

8. A connector according to any one of claims 1, 3 and 6 wherein the shaft is a tubular member formed integrally with the metal strip of the locking member to project out of its both sides in its widthwise direction and shaft receiving holes are made in the upper and lower interior surfaces of the cover for receiving the shaft.

9. A connector according to any one of claims 1, 3 and 6 wherein the cover has a stopper formed integrally therewith for preventing the release lever from being pressed into the recess in excess of a predetermined depth.

10. A connector comprising:

a connector body of an insulating material having molded integrally therewith a protrusion on the front thereof, a plurality of contact receiving holes being made in the front of the protrusion;

receptacle contacts fixedly received in the contact receiving holes;

locking pieces molded integrally with the connector body at both end portions of its front to extend forwardly thereof along side faces of the protrusion and each having at its projecting end portion an outwardly projecting click formed integrally therewith;

a shell made of metal for receiving the protrusion to cover its outer peripheral surface;

a flange formed integrally with the rear end face of the shell and fixed to the front of the connector body; and square reinforcing frames formed integrally with the flange to extend forwardly from both its side end portions for receiving the locking pieces, respectively.

11. A connector according to claim 10 wherein enlongated grooves are each cut in a front end face of each locking piece along the entire length thereof for receiving a front bar of a corresponding one of the reinforcing frames.

12. A connector according to claim 11 wherein each locking piece has formed integrally therewith reinforcing ribs extending in the direction of its extension.

13. A connector according to claim 11 or 12 wherein the front end face of each click has an outwardly tapered slope.

* * * * *